US011026022B1

(12) United States Patent
Tu et al.

(10) Patent No.: US 11,026,022 B1
(45) Date of Patent: Jun. 1, 2021

(54) AUDIO SIGNAL PROCESSING CIRCUIT AND AUDIO SIGNAL PROCESSING METHOD

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 16/740,507

(22) Filed: Jan. 13, 2020

(30) Foreign Application Priority Data

Nov. 18, 2019 (TW) ..... 108141813

(51) Int. Cl.
*H04R 3/04* (2006.01)
*H04R 3/00* (2006.01)

(52) U.S. Cl.
CPC ..... *H04R 3/04* (2013.01); *H04R 3/007* (2013.01); *H04R 2430/01* (2013.01)

(58) Field of Classification Search
None
See application file for complete search history.

(56) References Cited

U.S. PATENT DOCUMENTS 9,942,658 B2 * 4/2018 Zurek ..... H04R 3/007
2006/0088154 A1 * 4/2006 Mukhtar ..... H04M 1/6016 379/390.01
2011/0038490 A1 * 2/2011 Yang ..... H03G 5/165 381/103
2011/0170710 A1 * 7/2011 Son ..... H04R 5/04 381/98
2015/0010168 A1 * 1/2015 Cheng ..... H03G 9/025 381/107
2017/0134857 A1 * 5/2017 Zurek ..... H04R 3/14
2018/0352329 A1 * 12/2018 Klingler ..... H04R 1/2811

FOREIGN PATENT DOCUMENTS

CN 102291205 11/2013

* cited by examiner

*Primary Examiner* — Paul W Huber
(74) *Attorney, Agent, or Firm* — JCIPRNET

(57) ABSTRACT

The disclosure provides an audio signal processing circuit and an audio signal processing method, adapted for processing the input signal of a speaker configured with a rated power. The audio signal processing circuit includes, but not limited to, an audio signal generator and a power adjuster. The audio signal generator provides an audio signal including a high-frequency signal and a middle and low-frequency signal. The power adjuster is electronically coupled to the audio signal generator, and adjusts the power of the high-frequency signal according to an enhanced power larger than the rated power without adjusting the power of the middle and low-frequency signal. The output signal of the power adjuster can be inputted into the speaker. Accordingly, the transmission range for the high-frequency signal can be improved.

16 Claims, 6 Drawing Sheets

AUDIO SIGNAL PROCESSING CIRCUIT AND AUDIO SIGNAL PROCESSING METHOD

CROSS REFERENCE TO RELATED APPLICATION

This application claims the priority benefits of Taiwan application serial no. 108141813, filed on Nov. 18, 2019. The entirety of the above-mentioned patent application is hereby incorporated by reference herein and made a part of specification.

BACKGROUND

Field of the Disclosure

The present disclosure relates to a signal processing technology, and in particular to an audio signal processing circuit and an audio signal processing method.

Description of Related Art

Existing technologies can transmit additional information (e.g., configuration settings, authentication codes, device information, etc.) through high-frequency signals (e.g., signals above 18 kHz) in the audio signal. The human ear usually cannot hear the sound of these high-frequency signals. It should be noted that, as compared to the middle and low-frequency signals (for example, signals below 18 kHz), the energy of the high-frequency signal attenuates more rapidly as the propagation distance increases. Normally the rated power of the speaker driver provided for most mobile devices (such as mobile phones, tablets PC, handheld game players, etc.) or some electronic devices (such as monitors, notebooks, etc.) is not high (for example, 2 watt (W) or so).

FIG. 1 is a structural diagram of a conventional mobile device. Referring to FIG. 1, when the conventional mobile device plays the audio signal through applications, the volume level gain is adjusted by the audio engine before the audio signal reaches the speaker, and finally the signal is amplified through the power amplifier of the hardware so that the speaker can play the sound. To ensure that the output signal meets the rated power limit (e.g., 2 W) of the speaker driver, under the condition that the audio source with the maximum level (e.g., 0 dB relative to full scale (dBFS)) is played with the maximum volume level (e.g., the volume level gain is 1), the designer will adjust the gain of the power amplifier so that the output power is not greater than the rated power of the speaker driver.

If a user is to use audio signals for more useful applications, it is necessary to increase the output power of the power amplifier in the device. However, if only the output power of the power amplifier is increased to exceed the rated power limit of the speaker driver, the audio signal with increased power inputted to the speaker will inevitably cause the speaker driver to be burned.

SUMMARY OF THE DISCLOSURE

In view of the foregoing, an embodiment of the present disclosure provides an audio signal processing circuit and an audio signal processing method for amplifying an output power of a high-frequency signal in an audio signal within a safe power range.

An audio signal processing circuit according to an embodiment of the present disclosure is adapted to process a signal inputted to a speaker, and the speaker is configured to have a rated power. The audio signal processing circuit includes, but is not limited to, an audio signal generator and a power adjuster. The audio signal generator provides an audio signal, and the audio signal includes a high-frequency signal and a middle and low-frequency signal. The power adjustor is electrically coupled to the audio signal generator, and adjusts the power of the high-frequency signal according to the enhanced power without adjusting the power of the middle and low-frequency signal. The enhanced power is greater than the rated power, and the output signal of the power adjustor can be inputted to the speaker.

On the other hand, the audio signal processing method in the embodiment of the present disclosure is adapted to process a signal inputted to a speaker, and the speaker is configured to have a rated power. The audio signal processing method includes the following steps: generating an audio signal, and the audio signal includes a high-frequency signal and a middle and low-frequency signal. The power of the high-frequency signal is adjusted according to the enhanced power and the power of the middle and low-frequency signal is not adjusted. The enhanced power is greater than the rated power, and the signal of the high-frequency signal adjusted to have enhanced power can be inputted to the speaker. Static gain is provided to the middle and low-frequency signal according to the amplified power. The static gain is related to that the maximum power of the middle and low-frequency signal after power amplification is restricted to the rated power.

Based on the above, the audio signal processing circuit and the audio signal processing method of the embodiment of the present disclosure increase the output power of the high-frequency signal in the audio signal to be higher than the rated power of the speaker and within the safe power range of the speaker. In addition, for the middle and low-frequency signal in the audio signal, it is possible to restrict the output power thereof to be within the rated power. In this manner, the transmission distance of the high-frequency signal can be improved and the data error rate can be reduced while the driver can be prevented from burning.

In order to make the above features of the present disclosure more comprehensible, the following embodiments are described in detail with reference to the accompanying drawings.

DESCRIPTION OF EMBODIMENTS

Figure 1:
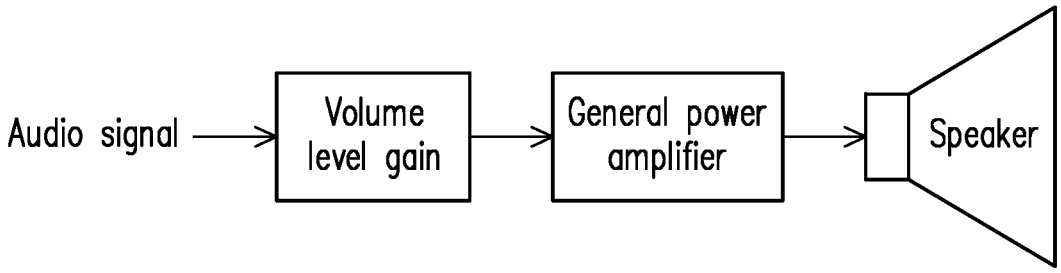
FIG. 1 is a structural diagram of a conventional mobile device.
Figure 2:
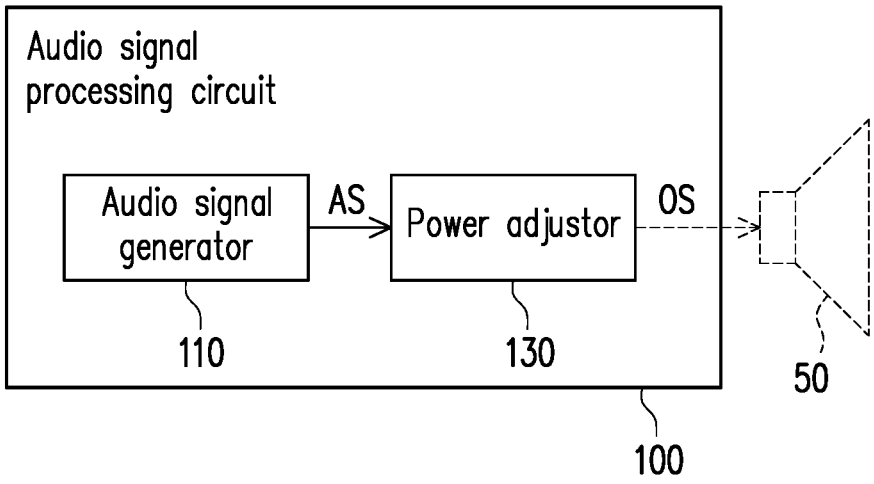
FIG. 2 is a block diagram showing elements of an audio signal processing circuit according to an embodiment of the disclosure.

FIG. 2 is a block diagram showing elements of an audio signal processing circuit 100 according to an embodiment of the disclosure. Referring to FIG. 2, the audio signal processing circuit 100 includes but is not limited to an audio signal generator 110 and a power adjuster 130. The audio signal processing circuit 100 can be disposed in an electronic device such as a mobile phone, a tablet computer, a notebook computer, an All-in-One (MO) computer, a smart speaker, a smart home appliance, and the like. The audio signal processing circuit 100 can be connected to a speaker 50 such as a speaker, a loudspeaker, or the like for playing sound.

The audio signal generator 110 may be implemented through a central processing unit (CPU), or other programmable general-purpose or specific-purpose microprocessor, a digital signal processor (DSP), a field programmable gate array (FPGA), a programmable controller, an application-specific integrated circuit (ASIC) or other similar components or a combination of the above components. In some embodiments, the audio signal generator 110 may be composed of one or more digital circuits.

The power adjustor 130 is electrically coupled to the audio signal generator 110, and may include one or more digital or analog circuits. These circuits may be circuits such as power amplifiers and gain adjustment circuits. In an embodiment, the power adjustor 130 can be electrically coupled to the speaker 50 and play the output signal OS through the speaker 50.

In order to facilitate the understanding of the operation flow of the embodiment of the present disclosure, the operation flow of the audio signal processing circuit 100 in the embodiment of the present disclosure will be specifically described in the following embodiments below. Hereinafter, the method in the embodiment of the present disclosure will be described with reference to each device in the audio signal processing circuit 100. The processes of the method can be adjusted according to the circumstances of implementation, and are not limited thereto.

Figure 3:
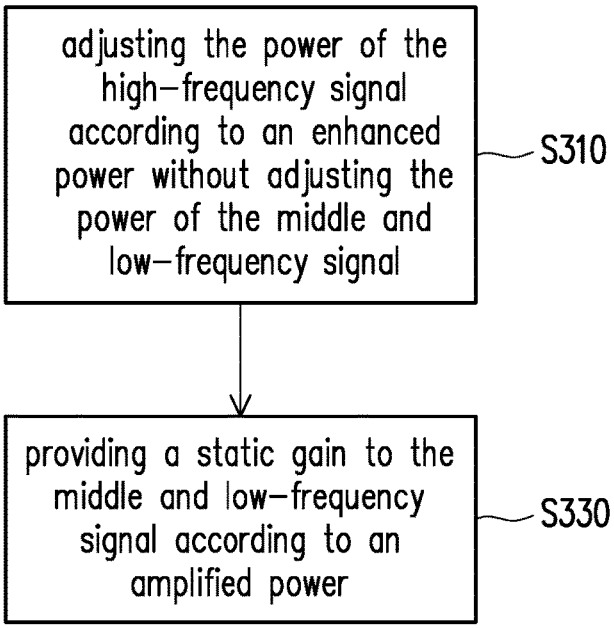
FIG. 3 is a flow chart diagram of an audio signal processing method according to an embodiment of the disclosure.

FIG. 3 is a flow chart diagram of an audio signal processing method according to an embodiment of the disclosure. Referring to FIG. 3, the audio signal generator 110 generates an audio signal AS (step S310). Specifically, the audio signal AS may include a high-frequency signal (e.g., the frequency thereof exceeds a certain threshold (e.g., 18, 20, or 25 kilohertz (kHz)), or a combination of a high-frequency signal and a middle and low-frequency signal (e.g., the frequency thereof is lower than a certain threshold (for example, 18, 20 or 25 kHz)). For example, the frequency band of high-frequency signal is 18~24 kHz. The high-frequency signal may include information or data such as setting configuration, device information, instructions, and/or update files, and the middle and low-frequency signal may be various types of audio signals such as music, speech, and audio books, which are not limited in the embodiment of the present disclosure. It should be noted that it can be assumed the audio signal AS is generated by the sound source with the maximum level (0 dBFS).

The power adjuster 130 receives the audio signal AS and adjusts the power of the high-frequency signal in the audio signal AS according to the enhanced power (step S330). Specifically, assume that the speaker 50 is configured with a specific rated power (e.g., 2, 4 or 8 watts (W), etc.) It should be mentioned that the rated power of the driver of the speaker 50 is mainly the protection mechanism for this speaker 50 with respect to all frequency signals. It can be observed through experiments that because the high-frequency signal changes faster, even if the energy of the high-frequency signal slightly exceeds the rated power (for example, 1, 2 or 4 W, etc.), the speaker 50 will not be burnt. Based on the results of the experiment, one of the concepts of the embodiments of the present disclosure is to amplify the energy of the high-frequency signal beyond the rated power of the driver of the speaker 50. The maximum output power (assuming under the condition of the sound source with the maximum level (for example, 0 dBFS) and the maximum volume level (for example, the volume level gain is 1 and is the maximum value)) of the high-frequency signal is defined as enhanced power in the embodiment of the present disclosure, and the ratio of the maximum output power to the overall rated power is a (greater than 1) (i.e., the enhanced power is greater than the rated power).

In an embodiment, if taking the safe power range of the driver of the speaker 50 into consideration, the enhanced power may be the maximum power that the speaker 50 can bear at the half of the sampling frequency of the audio signal AS. In another embodiment, the enhanced power can be set as any value in the aforementioned safe power range. In other embodiments, the value of the enhanced power may vary depending on the material or component of the driver.

It can be seen that, for high-frequency signal, the embodiment of the present disclosure increases the output power of the high-frequency signal and allows the output power to exceed the rated power of the driver of the speaker 50. The output signal OS of the power adjuster 130 is inputted to the speaker 50 and played through the speaker 50, thereby effectively increasing the transmission distance of the high-frequency signal and reduces the error rate.

In order to facilitate the reader understand the inventive concept of the embodiments of the present disclosure, several embodiments will be described below.

Figure 4:
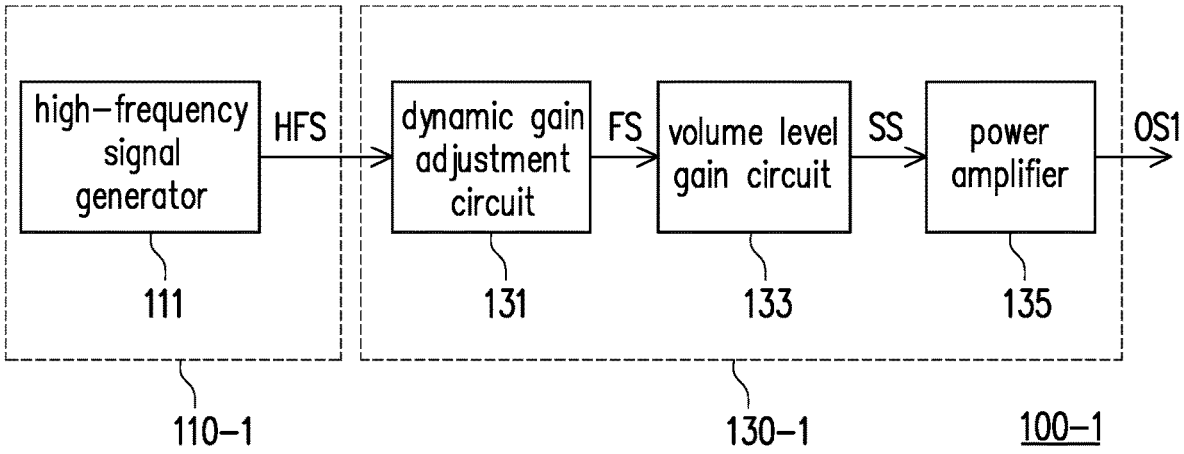
FIG. 4 is a block diagram showing elements of an audio signal processing circuit according to an embodiment of the disclosure.

FIG. 4 is a block diagram showing elements of an audio signal processing circuit 100-1 according to an embodiment of the disclosure. Referring to FIG. 4, the audio signal generator 110-1 of the audio signal processing circuit 100-1 includes a high-frequency signal generator 111. The high-frequency signal generator 111 is used to generate a high-frequency signal HFS.

The power adjuster 130-1 includes a dynamic gain adjustment circuit 131, a volume level gain circuit 133, and a power amplifier 135. The dynamic gain adjustment circuit 131 is electrically coupled between the audio signal generator 110-1 and the volume level gain circuit 133, and receives the high-frequency signal HFS outputted by the audio signal generator 110-1, and provides dynamic gain to the high-frequency signal HFS to output the first signal FS, wherein the determining of the dynamic gain is to be described in detail later.

The volume level gain circuit 133 is electrically coupled between the dynamic gain adjustment circuit 131 and the power amplifier 135, and provides a volume level gain corresponding to a volume setting operation to the first signal FS in response to the volume level setting operation to output the second signal SS. Assuming that the volume level gain is adjustable by the user, the volume level setting operation on the volume level gain performed by the user and received by the power adjuster 130-1 from the input device (e.g., button, rotating plate, mouse, etc.) can be used to set the volume level gain. For example, in the volume setting operation that the rotating plate rotates clockwise by one level, the volume level can be correspondingly ascended by one level. In an embodiment, the volume level gain is a value between 0 and 1, i.e., the maximum volume level gain is 1 (the minimum volume level gain may be 0 or other values).

In addition, the power amplifier 135 is configured to have an amplified power (assuming under the condition of the maximum sound source (for example, 0 dBFS) and the maximum volume level gain), and the amplified power is supplied to the second signal SS to output an output signal OS1. Compared with the conventional power amplifier of which the output power is set to the rated power of the speaker 50, and the amplified power of the power amplifier 135 is not less than the enhanced power. For example, the rated power is 2 W and the amplified power is 6 W (i.e., it may exceed the safe power range (for example, 3.5~4 W) of the driver of the speaker 50). The power amplifier 135 can provide the output signal OS1 thereof to the speaker 50.

It should be mentioned that the user may adjust the volume level, so that the energy of the high-frequency signal HFS is reduced. If the high-frequency signal HFS is to be maintained at the maximum volume level and the transmission distance of the high-frequency signal HFS is to reach further, the dynamic gain may be related to the inverse ratio of the volume level gain. In an embodiment, the dynamic gain can be derived from equation (1):

$$c = \begin{cases} (aX)/(Yg), \text{ if } g > (aX)/Y \\ 1, \text{ if } g \leq (aX)/Y \end{cases}, \quad (1)$$

where c is the dynamic gain, a is the ratio of the enhanced power to the rated power, X is the rated power, Y is the amplified power, and g is the volume level gain.

Figure 5:
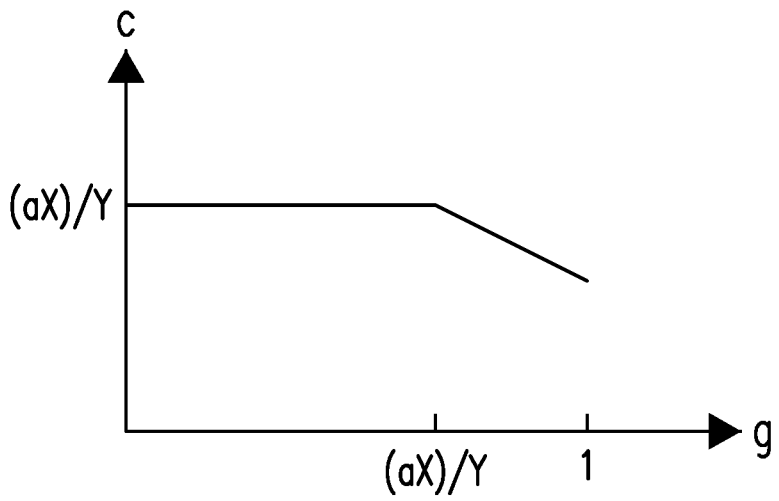
FIG. 5 is a volume level gain-dynamic gain diagram according to an embodiment of the disclosure.

FIG. 5 is a volume level gain-dynamic gain diagram according to an embodiment of the disclosure. Please refer to FIG. 5, when the volume level gain g is 1 to (aX)/Y, the dynamic gain c is inversely proportional to the volume level gain g, such that the output power of the output signal OS1 is aX (i.e., enhanced power). It should be noted that if the volume level gain is too small, the dynamic gain will be greater than 1, and the problem of signal clipping will be caused. Therefore, the condition that the dynamic gain is inversely proportional to the volume level gain is limited to the circumstances where the volume level gain is greater than (aX)/Y. If the volume level gain is not greater than (aX)/Y, the dynamic gain is maintained at 1 (or other constant) so that the output power of the output signal OS1 is gY.

Figure 6:
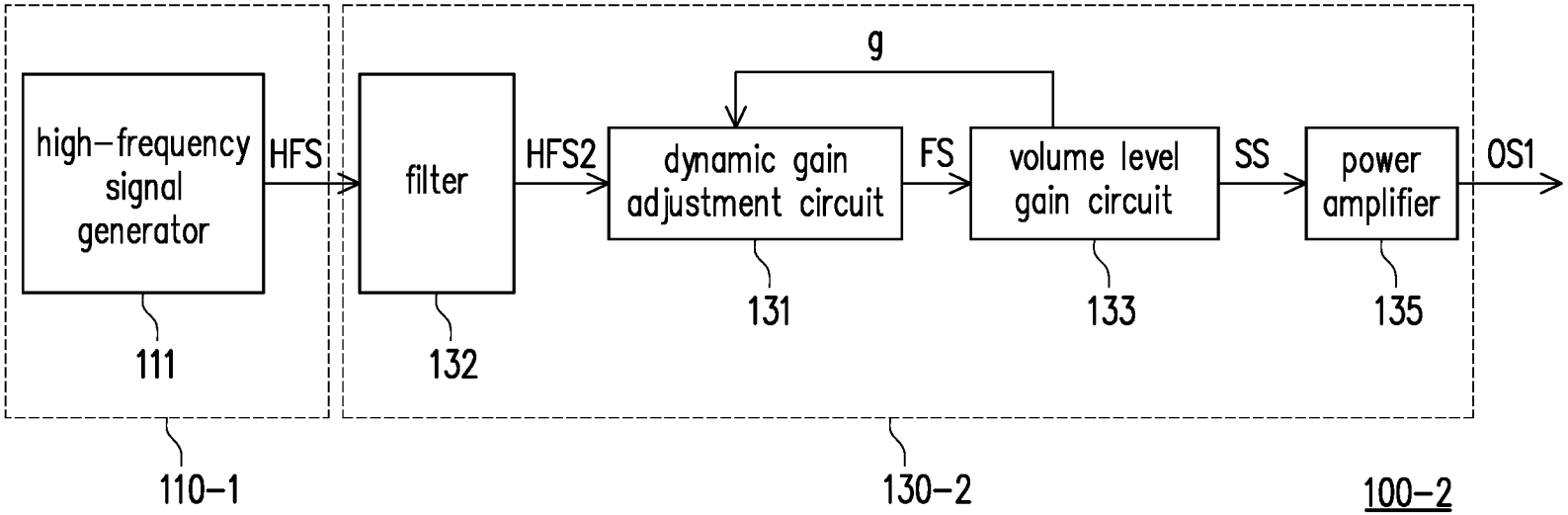
FIG. 6 is a block diagram showing elements of an audio signal processing circuit according to an embodiment of the disclosure.

FIG. 6 is a block diagram showing elements of an audio signal processing circuit 110-2 according to an embodiment of the disclosure. Referring to FIG. 6, the difference between FIG. 6 and the embodiment of FIG. 5 is that the power adjuster 130-2 of the audio signal processing circuit 110-2 further includes a filter 132. Different from the conventional filter which mainly adopts passband, the embodiment of the present disclosure mainly adopts the transition band thereof, and the filter 132 matches the power corresponding to the transition band of the high-frequency signal HFS to the safe power range (assuming that the power is between rated power and enhanced power) of the driver of the speaker 50.

Figure 7:
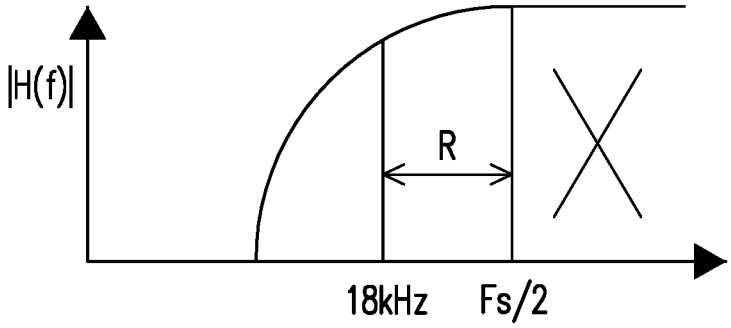
FIG. 7 is a frequency response diagram of a filter according to an embodiment of the present disclosure.

FIG. 7 is a frequency response (H(f)) diagram of the filter 132 according to an embodiment of the present disclosure. Please refer to FIG. 7, which shows the frequency range R (for example, 18 kHz~24 kHz (half of the sampling frequency Fs)) used by the high-frequency signal HFS. The transition band of the high pass filter 132 can be configured to include 18 kHz to 24 kHz, and the transition band can correspond to different safe power ranges (e.g., 3.5 W~4 W) of the driver of the speaker 50, such that the attenuation property of the high-frequency signal HFS2 outputted by the high pass filter 132 can meet the save power range requirement, thereby ensuring that the signal of each frequency of the high-frequency signal HFS will not cause the risk of burning the driver.

Figure 8:
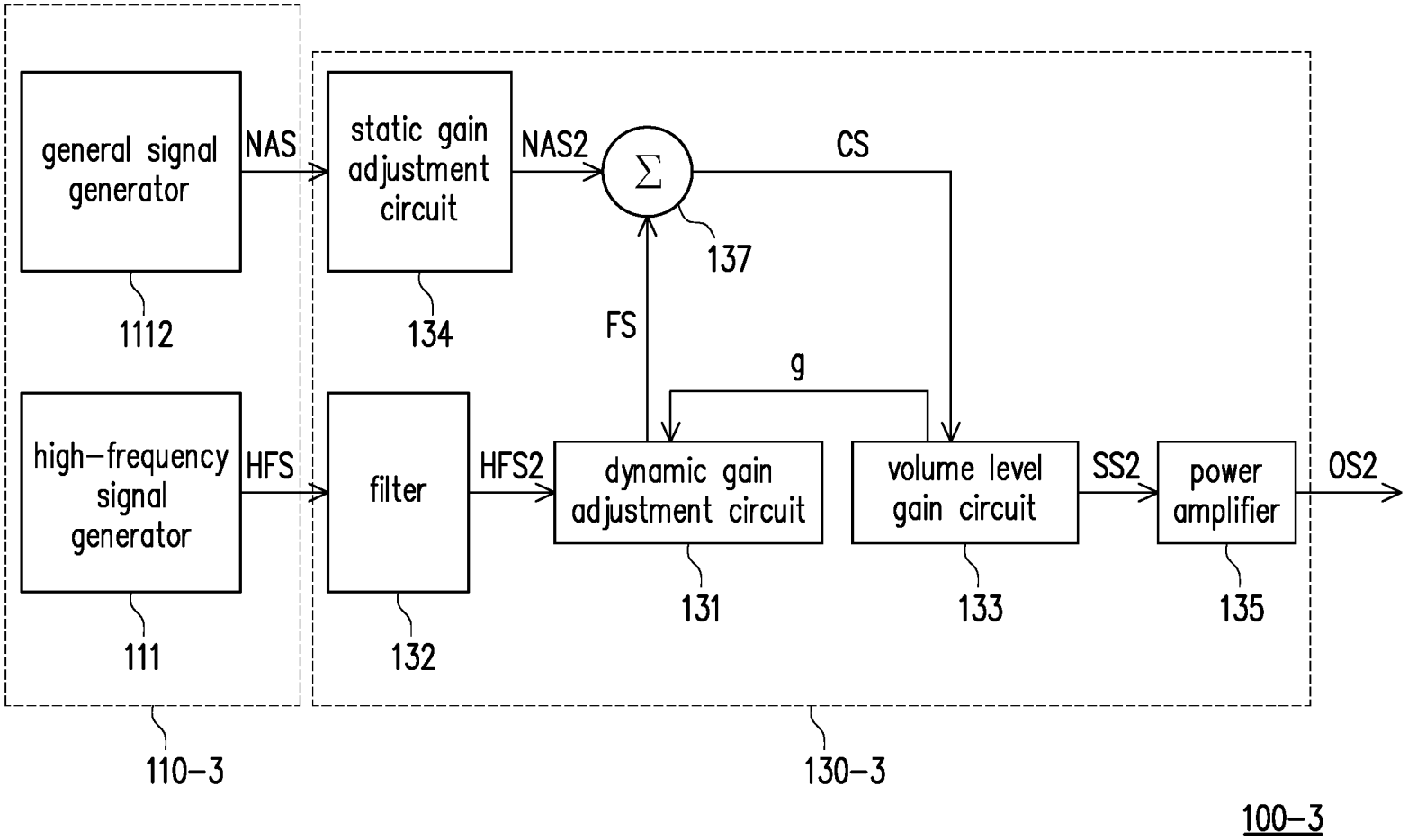
FIG. 8 is a block diagram showing elements of an audio signal processing circuit according to an embodiment of the disclosure.

FIG. 8 is a block diagram showing elements of an audio signal processing circuit 100-3 according to an embodiment of the disclosure. Referring to FIG. 8, the difference between FIG. 8 and the embodiment of FIG. 6 is that the audio signal generator 110-3 of the audio signal processing circuit 100-3 further includes a general signal generator 1112, and the power adjuster 130-2 further includes a static gain adjustment circuit 134 and summing circuit 137 (for example, a circuit such as a summation circuit or a programmable gain amplifier).

The general signal generator 1112 is configured to generate a middle and low-frequency signal NAS. The static gain adjustment circuit 134 is electrically coupled between the general signal generator 1112 of the audio signal generator 110-3 and the power amplifier 135. The static gain adjustment circuit 134 receives the middle and low-frequency signal NAS outputted by the general signal generator 1112, and provides a fixed static gain according to the amplified power of the power amplifier 135. It should be noted that in order to make the final output power of the middle and low-frequency signal NAS not to exceed the rated power (the driver is likely to be burned if the final output power exceeds the rated power), the static gain is related to that the maximum power of the middle and low-frequency signal NAS amplified by the power amplifier 135 is restricted to the rated power (for example, the maximum value is not greater than the rated power). For example, the static gain can be set to the ratio of rated power to amplified power (i.e., X/Y), so that the middle and low-frequency signal NAS maintains its output power at rated power (i.e., X) under the condition of the maximum sound source and the maximum volume level.

On the other hand, considering that the middle and low-frequency signal NAS can be normally played while transmitting information through the high-frequency signal HFS, the summing circuit 137 adds up/sums up the middle and low-frequency signal NAS2 (the signal outputted by the static gain adjustment circuit 134) and the first signal FS outputted by the dynamic gain adjustment circuit 131 to generate a combined signal CS. The volume level gain circuit 133 further adjusts the combined signal CS according to the volume level gain. Finally, the output signal OS2 outputted by the power amplifier 135 may include the content of the middle and low frequency signal NAS and the high-frequency signal HFS.

In summary, the audio signal processing circuit and the audio signal processing method of the embodiment of the present disclosure increase the output power of the high-frequency signal for transmitting data while complying with the safe range of the driver, thereby improving the transmission distance of the high-frequency signal and preventing the driver from burning. In addition, the high-frequency signal can be maintained at the enhanced power as the volume level changes, and the signal clipping problem can be avoided as well. More notably, in addition to outputting high-frequency signals, the audio signal processing circuit can simultaneously output middle and low-frequency signals, which allows the speaker to play music normally at the rated power.

Although the present disclosure has been disclosed in the above embodiments, it is not intended to limit the present disclosure, and those skilled in the art can make some modifications and refinements without departing from the spirit and scope of the disclosure. Therefore, the scope of the present disclosure is subject to the definition of the scope of the appended claims.

What is claimed is:

1. An audio signal processing circuit adapted to process a signal inputted to a speaker, wherein the speaker is configured to have a rated power, the audio signal processing circuit comprising:

an audio signal generator providing an audio signal, wherein the audio signal comprises a high-frequency signal and a middle and low-frequency signal; and a power adjustor, electrically coupled to the audio signal generator, and adjusts the power of the high-frequency signal according to an enhanced power without adjusting the power of the middle and low-frequency signal, wherein the enhanced power is greater than the rated power, and an output signal of the power adjustor can be inputted to the speaker.

2. The audio signal processing circuit of claim 1, wherein the power adjustor comprises:

a power amplifier configured to have an amplified power, wherein the amplified power is not less than the enhanced power, and the power amplifier is configured to provide an output signal thereof to the speaker;

a volume level gain circuit electrically coupled to the power amplifier and, in response to a volume level setting operation, providing a volume level gain corresponding to the volume level setting operation; and a dynamic gain adjustment circuit electrically coupled between the audio signal generator and the volume level gain circuit, receiving the high-frequency signal outputted by the audio signal generator, and providing a dynamic gain to the high-frequency signal according to the volume level gain, wherein the dynamic gain is related to an inverse ratio of the volume level gain.

3. The audio signal processing circuit of claim 2, wherein the power adjustor further comprises:

a static gain adjustment circuit electrically coupled between the audio signal generator and the power amplifier, receiving the middle and low-frequency signal outputted by the audio signal generator, and providing a static gain according to the amplified power, wherein the static gain is related to that a maximum power of the middle and low-frequency signal amplified by the power amplifier is restricted to the rated power.

4. The audio signal processing circuit of claim 3, wherein the static gain is a ratio of the rated power to the power amplifier.

5. The audio signal processing circuit of claim 3, wherein the power adjustor further comprises:

a summing circuit, combining the middle and low-frequency signal outputted from the static gain adjustment circuit and a signal outputted from the dynamic gain adjustment circuit to generate a combined signal, wherein the volume level gain circuit adjusts the combined signal according to the volume level gain.

6. The audio signal processing circuit of claim 2, wherein the dynamic gain is not larger than 1.

7. The audio signal processing circuit of claim 6, wherein the dynamic gain is $$c = \begin{cases} (aX)/(Yg), \text{ if } g > (aX)/Y \\ 1, \text{ if } g \leq (aX)/Y \end{cases},$$

wherein c is the dynamic gain, a is a ratio of the enhanced power to the rated power, X is the rated power, Y is the amplified power, and g is the volume level gain, wherein a maximum value of the volume level gain is 1.

8. The audio signal processing circuit of claim 1, wherein the power adjustor comprises:

a filter electrically coupled to the audio signal generator, and matching a power corresponding to a transition band of the high-frequency signal with a safe power range of the speaker, wherein the safe power range is between the rated power and the enhanced power.

9. The audio signal processing circuit of claim 1, wherein the enhanced power is a maximum power that the speaker can bear at the half of a sampling frequency of the audio signal.

10. An audio signal processing method, adapted to process a signal inputted to a speaker, wherein the speaker is configured to have a rated power, the audio signal processing method:

generating an audio signal, wherein the audio signal comprises a high-frequency signal and a middle and low-frequency signal;

adjusting the power of the high-frequency signal according to an enhanced power without adjusting the power of the middle and low-frequency signal, wherein the enhanced power is greater than the rated power, and a signal of the high-frequency signal adjusted to have the enhanced power can be inputted to the speaker; and providing a static gain to the middle and low-frequency signal according to an amplified power, wherein the static gain is related to that a maximum power of the middle and low-frequency signal amplified by the power amplifier is restricted to the rated power.

11. The audio signal processing method of claim 10, wherein the step of adjusting the power of the high-frequency signal according to the enhanced power comprises:

providing a dynamic gain to the high-frequency signal to output a first signal;

providing, in response to a volume level setting operation, a volume level gain corresponding to the volume level setting operation to the first signal to output a second signal, wherein the dynamic gain is related to an inverse ratio of the volume level gain; and providing the amplified power to the second signal to output an output signal, wherein the output signal is provided to the speaker.

12. The audio signal processing method of claim 10, wherein the static gain is a ratio of the rated power to the power amplifier.

13. The audio signal processing method of claim 11, further comprising:

combining the middle and low-frequency signal amplified by the static gain and the first signal to generate a combined signal, wherein the combined signal is adjusted according to the volume level gain.

14. The audio signal processing method of claim 11, wherein the dynamic gain is $$c = \begin{cases} (aX)/(Yg), \text{ if } g > (aX)/Y \\ 1, \text{ if } g \leq (aX)/Y \end{cases},$$

wherein c is the dynamic gain, a is a ratio of the enhanced power to the rated power, X is the rated power, Y is the amplified power, and g is the volume level gain, wherein a maximum value of the volume level gain is 1.

15. The audio signal processing method of claim 10, further comprising:

matching a power corresponding to a transition band of the high-frequency signal with a safe power range of the speaker, wherein the safe power range is between the rated power and the enhanced power.

16. The audio signal processing method of claim 10, wherein the enhanced power is a maximum power that the speaker can bear at the half of a sampling frequency of the audio signal.

* * * * *